United States Patent [19]

Tsuruta et al.

[11] 4,051,215

[45] Sept. 27, 1977

[54] PROCESS FOR IMPARTING ELASTICITY TO WOVEN TEXTILE FABRICS

[75] Inventors: Motohiro Tsuruta, Kyoto; Hiroshiro Kimura, Ashiya; Akio Koshimo; Hirohisa Nara, both of Uji, all of Japan; Tokuju Goto, Dusseldorf, Germany; Kunio Amemiya, Kyoto, Japan

[73] Assignee: Unitika Kabushiki Kaisha, Osaka, Japan

[21] Appl. No.: 645,721

[22] Filed: Dec. 31, 1975

Related U.S. Application Data

[60] Continuation-in-part of Ser. No. 552,453, Feb. 24, 1975, abandoned, which is a continuation of Ser. No. 68,263, Aug. 26, 1970, abandoned, which is a division of Ser. No. 711,668, March 8, 1968, Pat. No. 3,538,563.

[51] Int. Cl.[2] ..... B29G 5/00

[52] U.S. Cl. ..... 264/137; 264/136; 264/280; 264/282

[58] Field of Search ..... 264/136, 280, 284, 324, 264/282, 137; 26/18.6

[56] References Cited

U.S. PATENT DOCUMENTS

| | | | |
|---|---|---|---|
| 3,267,549 | 8/1966 | Rand | 26/18.6 X |
| 3,469,292 | 9/1969 | Hojyo | 26/18.6 X |
| 3,530,510 | 9/1970 | Rabold | 26/18.6 |

*Primary Examiner*—Richard R. Kucia
*Attorney, Agent, or Firm*—Wolder & Gross

[57] ABSTRACT

The present invention relates to a process for treating woven textile fabrics. In one aspect, the present invention relates to a process for imparting elasticity to a woven textile fabric in its warp direction in which a cellulose reactive resin solution is applied to a woven textile fabric, the fabric compressed in its warp direction by means of a rubber roller and an elastic flexible belt, and then fixed in its altered state.

4 Claims, 1 Drawing Figure

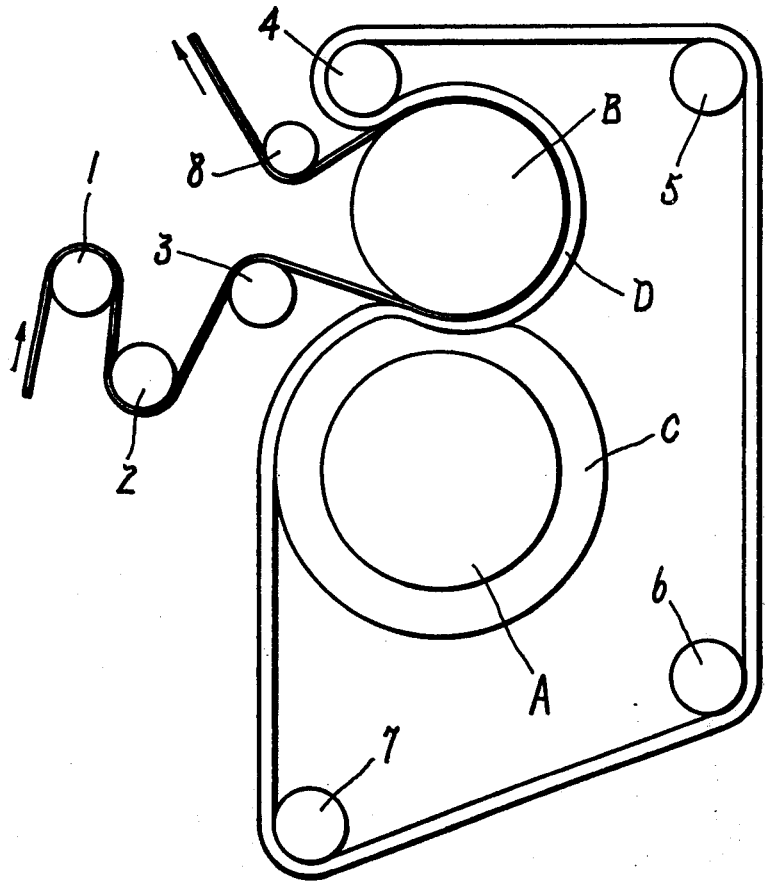
4
B
8
5
1
3
D
1
2
C
6
A
7

PROCESS FOR IMPARTING ELASTICITY TO WOVEN TEXTILE FABRICS

RELATED APPLICATIONS

This application is a continuation-in-part of the pending U.S. Ser. No. 552,453, filed Feb. 24, 1975, now abandoned which in turn is a continuation of U.S. Ser. No. 68,263, filed Aug. 26, 1970, now abandoned which in turn is a divisional of U.S. Ser. No. 711,668, filed Mar. 8, 1968, now U.S. Pat. No. 3,538,563, all for the instant inventors.

SUMMARY OF INVENTION

The present invention relates to a process for imparting elasticity to a woven textile fabric made of thermoplastic textile yarns, which process comprises rotating a heating drum, rotating a deformable elastic roller, the drum and the roller having parallel axis, passing a flexible elastic belt through the nip between the drum and the roller, contacting the belt with the heating drum around a substantial proportion of its periphery beyond the nip, applying a cellulose reactive resin solution to the fabric feeding the fabric in its warp direction into the nip between the heating drum and the flexible belt so as to shrink the fabric by 10 to 30% in its warp direction, temporarily heat-setting the fabric in its altered state by contacting it with the heating drum, and then permanently fixing it, e.g. by heat-setting the shrunk fabric in its strongly bent state.

The woven textile fabric, which may be used for the purpose of the present invention, is for example made of thermoplastic blended spun yarns composed of 50–80% of poly-ether-ester or polyester fibers and 50–20% of cellulose fibers such as cotton or rayon in its warp direction. These same yarns, or 100% of textured poly-ether-ester yarns or 100% of textured polyester yarns are used in its weft direction. When the yarns in warp direction are composed of less than 50% of poly-ether-ester or polyester fibers, the heat-setting involved in the process of the present invention can not be sufficiently effected. On the other hand, when the amount of poly-ether-ester or polyester fiber to be used in the warp direction is more than 80%, the fabric prepared is too rigid to use.

As weft yarns, any and all thermoplastic textile yarns can be used. However, it is preferred to use the same yarns as those in the warp direction of 100% of textured poly-ether-ester yarns. It is also possible to use 100% of textured polyester yarns. The woven textile fabric used for the present invention has a relatively low initial web density in its weft direction, which is increased by 5–60%, preferably 10–35% by the process of the present invention.

In case the woven textile fabric is singed, scoured or dyed before subjecting it to the process according to the present invention, such pre-treatments must be carried out at a sufficiently low temperature so that the fabric is not completely heat-set because the fabric should only be completely heat-set after being compressed in its warp direction. In order to prevent undesired deformation, the fabric may be temporarily heat-set, but complete heat-setting in this stage can give rise to difficulties in carrying out the process of the present invention.

Prior to being shrunk, a cellulose reactive resin solution is applied to the woven textile fabric made of thermoplastic blended spun yarns so that the cellulose portions are effectively fixed by heating. It is then adjusted to a suitable water content.

Resins of the following types can preferably be used for this purpose: dimethylol urea, glyoxal monoureine, dimethylol ethylene urea, dimethylol triazone, propylene urea, modified triazine, acetal, carbamate, carbamide, polyacrylamide and acrylic acid ester.

After the cellulose reactive resin solution is applied, the fabric is compressed in its warp direction by using a specifically designed compactor and is then temporarily heat-set by contacting it with the heating drum.

The compactor is capable of compressing the fabric under compulsion in its warp direction and is fully described below with reference to the accompanying drawing.

DRAWING

The accompanying drawing is a cross sectional view showing schematically the essential elements of a compactor designed for carrying out the process according to the present invention.

SPECIFIC EMBODIMENTS

A natural or synthetic rubber layer (C) having a thickness of 60–120 mm is provided around the surface of a rotatable iron roller (A). The surface temperature of a rotatable heating drum (B), which is provided adjacent to the roller (A,C) is adjustable to 120°–180° C. A flexible elastic belt (D) having a similar width to that of the heating drum (B) and composed of an elastic material such as rubber is passed through the nip between the heating drum (B) and the rubber roller (A,C) with deformation of the elastic roller (A,C) and the belt (D) in the nip, in such a manner that broad surfaces of the flexible elastic belt (D) closely contacts the rubber roller (A,C) and heating drum (B) before and after the nip. The elastic flexible belt (D) also contacts the drum (B) round a substantial portion of its periphery beyond the nip and is arranged to rotate in accordance with the rotation of the rubber roller (A,C) and heating drum (B). The rubber roller (A,C) which has substantially the same peripheral velocity as heating drum (B) is driven from heating drum (B) rotated positively via elastic belt (D).

In one embodiment of the compactor according to the present invention, rubber of the rubber roller (A,C) has a hardness of 20°–60° measured by JIS (Japanese Industrial Standard)-K 6301 — and the elasticity of the flexible elastic belt (D) is more than that of the rubber roller (A,C). The materials for the flexible elastic belt (D), which contacts directly with the heating roller (B) preferably are higher elastic materials having good heat stability, such as certain natural rubbers having good heat stability or synthetic rubbers. Rubber materials for the rubber roller (A,C) are preferably substances having good elasticity such as e.g., natural rubbers and synthetic rubbers.

At the time of compressing a fabric, which is fed into the compactor by means of tension bars (1), (2) and a guide bar (3), the rubber roller (A,C) is pressed against the heating drum (B), so that the rubber surface of the elastic roller (A,C) is deformed, and this deformation gives rise to large degrees of compression on the fabric. Additional compression of the fabric is caused by the flexible elastic belt (D). Not only is the belt similarly deformed in the same way as the elastic roller (A,C), but the flexible elastic belt (D) is also bent sharply, and its surface is expanded or shrunk correspondingly.

The fabric is first closely contacted with the expanded portion of the elastic belt (D) and is compressed by 10–30% according to the shrinkage of the elastic belt (D) so that warp yarns of the fabric are bent strongly. The amount of compression of the fabric depends partly upon the degree of deformation of the rubber layer structure (C) of the elastic roller (A,C) and of the belt (D), and partly upon the degree of bending of the belt (D). The flexible elastic belt (D) is guided by rollers (4), (5), and (6) and a guide roller (7), and the fabric is fed out by a roller (8).

The fabric, which was compressed in its warp direction by means of the aforesaid compactor, is temporarily heat-set in its altered state by contacting it with the heating drum (B) at a temperature of 130°–150° C and is then heat-treated at a temperature of 150°–200° C for 1–5 minutes without tension in its warp direction to completely heat-set the warp yarns in their strongly bent state and to improve its laundering properties. Conditions under which the fabric is completely heat-set depend upon the types of the yarns and the cellulose reactive resins which is applied to the fabric before compression. Preferable conventional heat-setting machines useful for thermoplastic textile fabrics can be employed.

The fabric thus treated according to the present invention has an excellent elastic recovery of 65–90% and an elongation of 10–25% in its warp direction. Such an unexpected result can be obtained by the combination of the use of specific textile raw material, the use of cellulose reactive resin solution and the specifically designed compactor.

The following non-limitative examples illustrate the invention. In the examples the elongation and the elastic recovery were determined by the following procedure.

Each sample had a length of 20 cm in its warp direction and a width of 5 cm in its weft direction. The elongation was measured by burdening a sample with a load of 2 Kg in its warp direction and comparing the elongation with the initial length of 20 cm. The elastic recovery was determined by burdening a sample with a suitable load so as to give an elongation of 20% in its warp direction, maintaining the fabric in the same state for 3 minutes, removing the load from the fabric and after one minute comparing the obtained shrinkage value with the initial elongation of 20 cm × 20/100.

EXAMPLE 1

A tropical woven textile fabric was prepared from a blended yarn composed of, in respective directions of warp and weft, 65% of co-polymerized poly-ether-ester fibers, which contained 85% by molar unit of ethylene terephthalate and 15% by molar unit of ethylene oxybenzoate, and 35% of rayon under the following weaving conditions:

| | Cotton Count | Density of the Fabric |
|---|---|---|
| Warp | 30/2 | 50 threads/inch |
| Weft | 30/2 | 47 threads/inch |

After singeing, the fabric was desized and scoured with a pad steamer. The fabric was washed with water in an open soaper, dried at 100° C for 3 minutes with a roller drier, padded with dyes, dried at 100° C for 3 minutes, and was treated at 120° C for 4 minutes to fix the dyes with saturated steam. After being treated with a soaper, the fabric was padded with a resin solution having the following composition. The fabric adsorbed 65% of its weight of the resin solution.

| Resin Solution | |
|---|---|
| Simitex Resin NS-1 (Commercial product of glyoxal monoureine resin available from Sumitomo Kagaku Kogyo K.K., Japan) | 15% |
| Noran Silicon Softener (Commercial product of silicon softener available from Nippon Reichhold K.K., Japan) | 2% |
| Saibinol P.N-3500 (Commercial product of polyethylene softener available from Sakiden Kagaku KK.K., Japan) | 2% |
| Zinc nitrate | 0.75% |
| Water | 80.25% |

The fabric was shrunk by 25% in its warp direction using the compactor shown in the drawing by the method described relative thereto, and was then temporarily heat set at 130° C by contacting the fabric with the heating drum. After this, the fabric was fixed in its altered state by baking at 160° C for 3 minutes with a short loop type baking machine. The resulting fabric had a good elasticity in its warp direction as shown in the following table and had finished densities of 55 threads/inch and 57 threads/inch in its warp and weft directions, respectively.

| | Finished Fabric | After Laundering 5 Times |
|---|---|---|
| Elongation | 17.5% | 17.0% |
| Elastic recovery | 67.5% | 87.7% |

EXAMPLE 2

A tropical woven textile fabric was prepared from a blended yarn composed of, in respective directions of warp and weft, 80% of poly-ether-ester fiber and 20% of cotton fiber under the following weaving conditions.

| | Cotton Count | Density of the Fabric |
|---|---|---|
| Warp | 20/2 | 44 threads/inch |
| Weft | 20/2 | 38 threads/inch |

The fabric was treated in a similar manner to that described in Example 1 with the exception that the fabric was shrunk by 30% in its warp direction. The resulting fabric had an excellent elasticity in its warp direction as shown in the following table and had finished densities of 47 threads/inch and 50 threads/inch in its warp and weft directions, respectively.

| | Finished Fabric | After Laundering 5 Times |
|---|---|---|
| Elongation | 23.8% | 24.7% |
| Elastic recovery | 81.4% | 89.2% |

EXAMPLE 3

A blended yarn (cotton count — 40) composed of 50% of polyester fiber and 50% of cotton fiber was used to prepare a fabric for a shirt. The densities of the fabric obtained were as follows:

| | |
|---|---|
| Warp | 135 threads/inch |

-continued

| | |
|---|---|
| Weft | 60 threads/inch |

The fabric was treated in similar manner to that described in Example 1 with the exception that the fabric was shrunk by 10% in its warp direction. The resulting fabric had a good elasticity in its warp direction as shown in the following table. The finished densities of the resulting fabric were 140 threads/inch and 70 threads/inch in its warp and weft directions, respectively.

| | Finished Fabric | After Laundering 5 Times |
|---|---|---|
| Elongation | 10.1% | 11.2% |
| Elastic recovery | 78.8% | 79.0% |

Having described the invention that is sought to be protected is set forth in the following claims.

1. A process for imparting elasticity to a woven textile fabric made of thermoplastic blended spun yarns made of 50–80% of poly-ether-ester or polyester fibers and 50–20% of cellulose fibers in its warp direction and in its weft direction a member of the group consisting of the same yarns as used in its warp direction, 100% of textured poly-ether-ester yarns, and 100% of textured polyester yarns, wherein said woven fabric fed to said process has a low initial web density in its weft direction, and the resultant fabric of the instant process has an elastic recovery of 65 to 90% and an elongation of 10 to 25% in its warp direction and has 5 to 60% greater web density than said feed fabric, which comprises:

a. rotating a heating drum, b. rotating a deformable elastic roller, the drum and the roller having a parallel axis and the same peripheral velocity, c. passing a flexible elastic belt through the nip between the drum and the roller, d. contacting the belt with the heating drum around a substantial proportion of its periphery beyond the nip, e. applying a cellulose reactive resin solution to the fabric, f. feeding the fabric so treated in its warp direction into the nip between the heating drum and the flexible belt so as to shrink the fabric by 10–30% in its warp direction, whereby said fabric is compressed owing to the deformation of the deformable elastic roller as well as the deformation of the flexible elastic belt, g. temporarily heat-setting the fabric in its altered state by contacting it with the heating drum at a temperature of 130°–150° C, and h. completely heat-setting the fabric at a temperature of 150°–200° C for a period of 1–5 minutes.

2. The process of claim 1 wherein said fabric is made of a blended yarn containing 50 to 80% poly-ether-ester fiber or polyester fiber and 50 to 20% cotton in both its warp and weft directions.

3. The process of claim 1 wherein said fabric is made of a blended yarn of 50 to 80% poly-ether-ester fibers and 50 to 20% of cotton or rayon.

4. The process of claim 1 wherein the cellulose reactive resin solution is a solution of a member of the group consisting of dimethylol urea, glyoxal monoureine, dimethylol ethylene urea, dimethylol triazone, propylene urea, modified triazine, acetal, carbamate, carbamide, polyacrylamide and acrylic acid ester.

* * * * *